US006186043B1

(12) United States Patent
Callies

(10) Patent No.: US 6,186,043 B1
(45) Date of Patent: Feb. 13, 2001

(54) CUSHION HYDRAULIC CYLINDER

(75) Inventor: Robert Edwin Callies, Leigh, NE (US)

(73) Assignee: Deere & Company, Moline, IL (US)

( * ) Notice: Under 35 U.S.C. 154(b), the term of this patent shall be extended for 0 days.

(21) Appl. No.: 09/286,359

(22) Filed: Apr. 5, 1999

(51) Int. Cl.[7] ..... F15B 15/22
(52) U.S. Cl. ..... 91/408; 91/422
(58) Field of Search ..... 91/408, 409, 422

(56) References Cited

U.S. PATENT DOCUMENTS

| | | | | |
|---|---|---|---|---|
| 3,229,589 | * | 1/1966 | Langas | 91/422 X |
| 3,592,106 | | 7/1971 | Baughman | 91/409 X |
| 4,089,251 | | 5/1978 | Louviot | 91/408 X |
| 4,151,784 | * | 5/1979 | Fussangel | 91/408 X |
| 4,424,737 | | 1/1984 | Endo . | |
| 4,425,836 | | 1/1984 | Pickrell . | |
| 4,651,623 | | 3/1987 | Rogers . | |
| 4,706,781 | | 11/1987 | Ikimi et al. . | |
| 4,767,255 | | 8/1988 | Mickelson et al. . | |
| 4,825,752 | * | 5/1989 | Kiffmeyer | 91/422 |
| 4,862,786 | | 9/1989 | Boyer et al. . | |
| 5,018,934 | | 5/1991 | Steinkamp et al. . | |

FOREIGN PATENT DOCUMENTS

| | | | | |
|---|---|---|---|---|
| 59490 | * | 9/1949 | (FR) | 91/422 |
| 227034 | * | 4/1966 | (RU) | 91/409 |

* cited by examiner

*Primary Examiner*—John E. Ryznic

(57) ABSTRACT

A cushion hydraulic cylinder is provided with a series of longitudinally separated metering orifices in the wall of the cylinder through which exhausted fluid is expelled. As the piston extends towards these metering orifices a seal sequentially cover and uncovers the metering orifices further restricting the flow of exhausted fluid. In addition the piston is provided with radial bores having one or more longitudinal passages which are in fluid communication with either the piston side of the cylinder or the rod side of the cylinder. The first longitudinal passage is provided with a passage orifice through which exhausted fluid can flow after a circumferential piston seal reopens a previously blocked metering orifice. The second longitudinal passage maybe provided with a check valve which prevents the flow of fluid in one direction.

11 Claims, 4 Drawing Sheets

CUSHION HYDRAULIC CYLINDER

BACKGROUND OF THE INVENTION

1. Field of the Invention

The invention is directed to a cushion hydraulic cylinder wherein metering orifices to control the speed of the piston are located in the cylinder and the piston.

2. Description of the Prior Art

Hydraulic cylinders comprise a cylindrical tube into which a piston is located for reciprocating back and forth in the piston in response to fluid pressure. The piston is provided with a rod that projects out of the cylindrical tube. Single acting hydraulic cylinders have a single hydraulic port directing fluid to the hydraulic cylinder. The piston is returned to its original position by a spring or some other suitable biassing mechanism when the fluid pressure is released. In double acting hydraulic cylinders each side of the piston is provided with a source of hydraulic pressure so that the piston is positively driven by the hydraulic pressure in both directions. In many applications the piston is provided with poppet valves which short circuit the flow of hydraulic fluid through the piston when the piston encounters the end caps of the cylindrical tube.

In some applications it is desirable to provide a hydraulic cylinder that slows down as the piston approaches the end caps. Such hydraulic cylinders are known as cushion hydraulic cylinders. Typically cushion hydraulic cylinders restrict the flow of exhaust fluid as the piston approaches the ends of its stroke thereby slowing the movement of the piston. One cushioning system uses multiple longitudinally arranged hydraulic metering orifices formed in the wall of the cylindrical tube for increasingly restricting the flow of exhaust fluid out of the hydraulic cylinder as the piston moves toward the end of its stroke. In other embodiments, the piston itself has been provided with longitudinally arranged hydraulic metering orifices. In addition, the top of the pistons themselves maybe provided with cap assemblies that restrict the flow of exhaust fluid out of the hydraulic cylinder.

SUMMARY OF THE INVENTION

It is an object of the present invention to provide a cushion hydraulic cylinder that better controls the acceleration and/or deacceleration of the piston.

It is a feature of the present cushion hydraulic cylinder that the cylinder and the piston both have flow control orifices for controlling the flow of hydraulic fluid to and from the cylinder.

A cushion hydraulic cylinder is provided with at least one longitudinally separated metering orifice in the wall of the cylinder through which the flow of fluid is regulated. As the piston extends towards these metering orifices, a circumferential seal sequentially covers and uncovers the metering orifices further regulating the flow of fluid. In addition, the piston is provided with radial bores, having longitudinal passages which are in fluid communication with either the piston side of the cylinder or the rod side of the cylinder. The first longitudinal passage is provided with a passage orifice through which fluid can flow after a circumferential piston seal unblocks a covered metering orifice. The second longitudinal passage is provided with a check valve which prevents the flow of exhausted fluid and only allows for the flow of pressurized fluid. In the illustrated embodiment, the passage orifice is smaller than any of the metering orifices however this is not necessary for the proper functioning of the invention.

It should also be noted that the illustrated embodiment has three metering orifices in the wall of the hydraulic cylinder. However, a single large orifice maybe used provided its diameter is greater than the width of the sealing rings on the piston.

DETAILED DESCRIPTION

Figure 1:
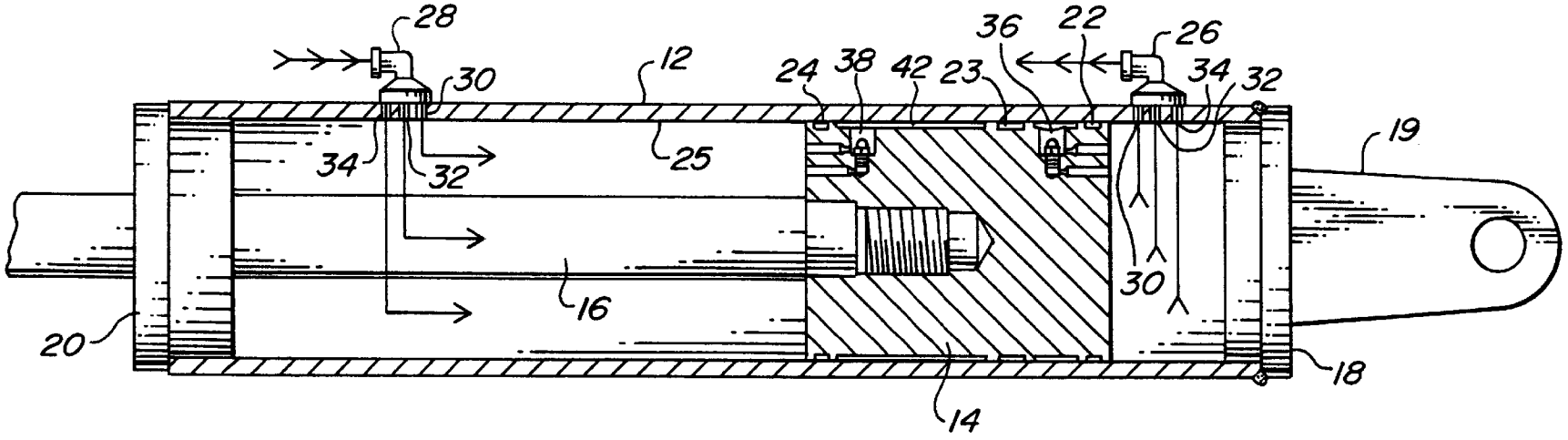
FIG. 1 is a cross sectional side view of a cushion hydraulic cylinder of the present invention

FIG. 1 discloses a hydraulic cylinder 10 comprising a hollow cylinder forming a tube 12 which receives a sliding piston 14 having a rod 16. Rod 16 is provided with a mounting assembly, not shown, for coupling the rod of some mechanism. The hollow cylinder 12 is provided with a piston side end cap 18 and a rod side end cap 20 through which rod 16 extends. The piston side end cap 18 is provided with a mounting assembly 19 for mounting the cylinder to a mechanism. The piston is provided with three circumferential seals 22, 23 and 24 which provide a sealing contact with the inside surface 25 of the tube 12. The hydraulic cylinder 10 illustrated in FIG. 1 is a double acting cylinder in which the acceleration and deacceleration of the piston is regulated in both directions. However the present invention could also be used on single acting hydraulic cylinders or double acting hydraulic cylinders in which movement in only one direction is regulated.

In the illustrated embodiment, the hollow cylinder is provided with two fluid ports 26 and 28 through which fluid enters and exits the tube 12. The first fluid port 26 is in fluid communication with a first set of three metering orifices 30, 32 and 34 passing through the cylindrical wall of the tube 12. The second fluid port 28 is in fluid communication with a second set of three metering orifices 30, 32 and 34 passing through the cylindrical wall of the tube 12. The three metering orifices 30, 32 and 34 of both sets are spaced longitudinally along the hollow cylinder 12.

The piston 14 is provided with first and second inwardly extending radial bores 36 and 38. Each bore is in fluid communication with a respective first and second cavity 40 and 42 located between the piston and the inside wall 25 of the tube 14 so that fluid can move between the metering orifices 30, 32 and 34 and the bores 36 and 38. Each bore is also provided with two longitudinally extending passages 44 and 46. The first passage 44 of each bore is provided with a passage orifice 48 and is fluid communication with either the rod side of the piston 14 or the piston side of the piston 14 depending on which bore it is associated with, as shown in FIG. 1. A check valve 50 is positioned in the second passage and prevents the flow of exhausted fluid from either the rod side of the piston 14 or the piston side of the piston 14 to the respective bore. The check valve 50 may be positioned radially oriented as shown in the attached figures or it maybe longitudinally oriented in longitudinally extending passage 46.

The cushioning operation, that is deaccelerating the piston as it reaches the end of its stroke, will be discussed with reference to FIGS. 1–5 during retraction of the hydraulic cylinder 10. It should be noted the cushioning function would operate in the same manner during extension except that a longer cavity is provided because of the location of the metering orifices. In addition, the flow to the hydraulic cylinder is restricted to control the acceleration of the piston as it starts its stroke from end caps 18 and 20

Figure 2:
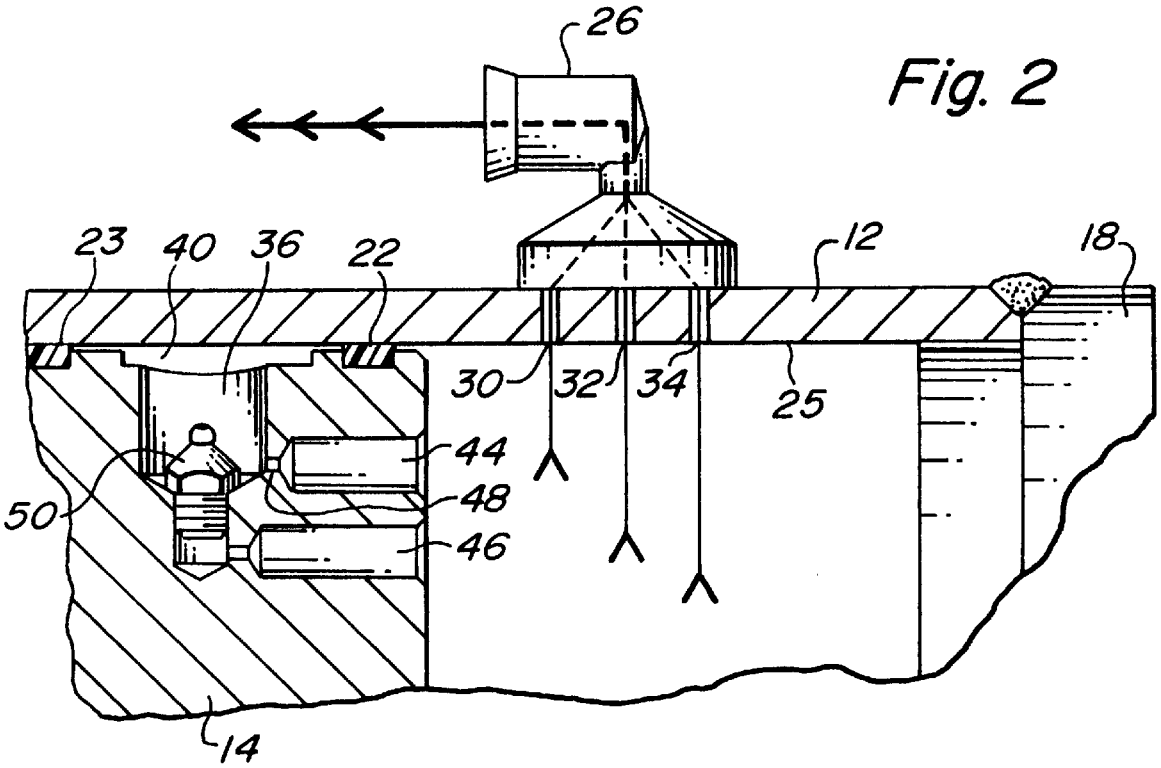
FIGS. 2–6 are partial cross sectional side views of the operation of the cushion feature of the present invention.
Figure 3:
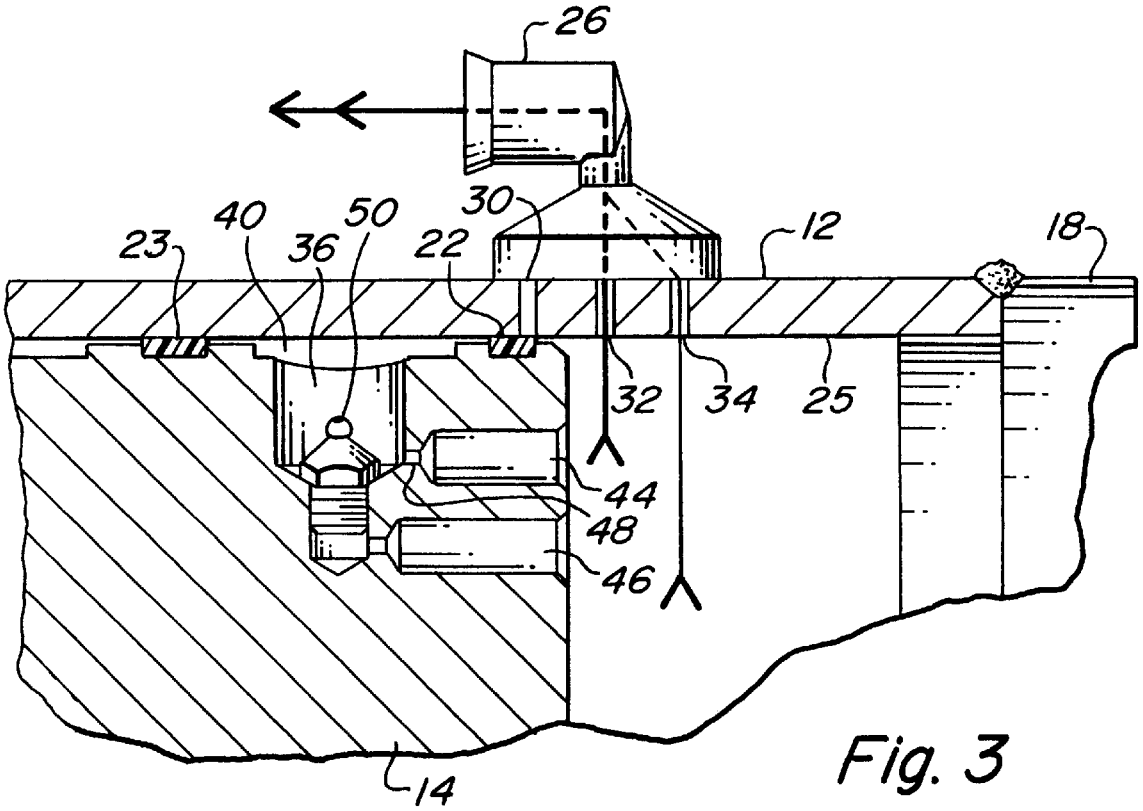
Figure 4:
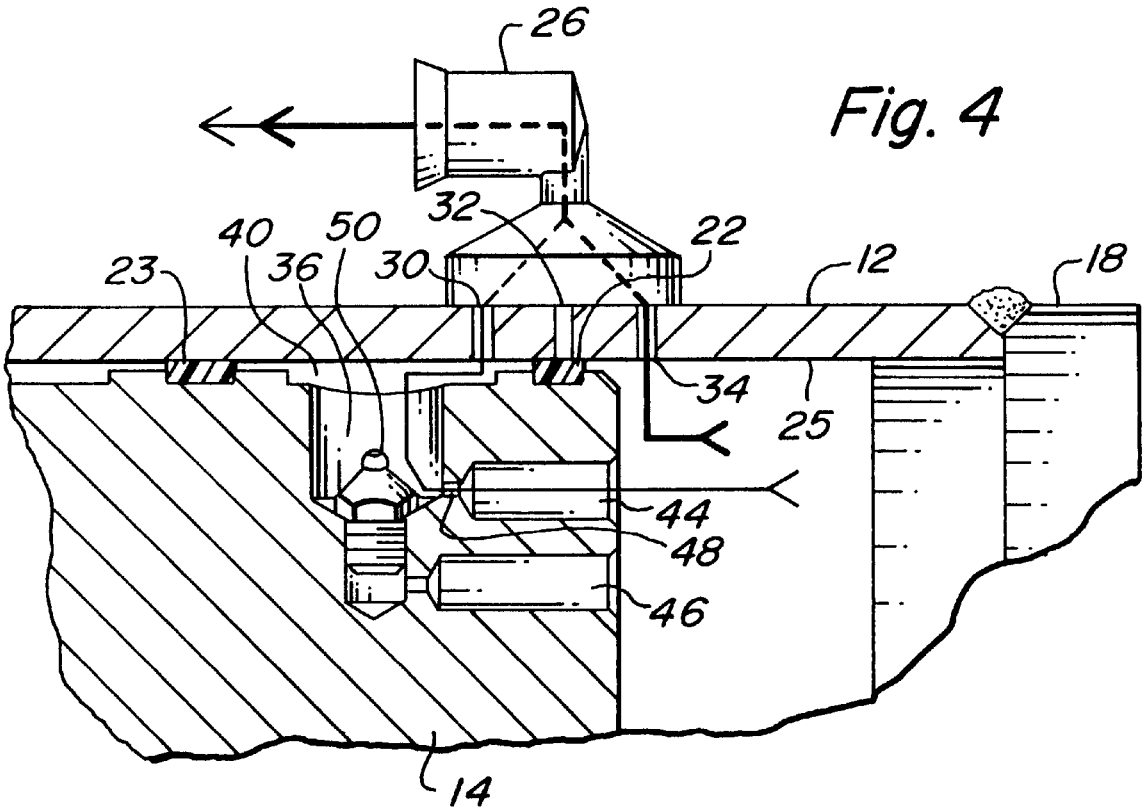
Figure 5:
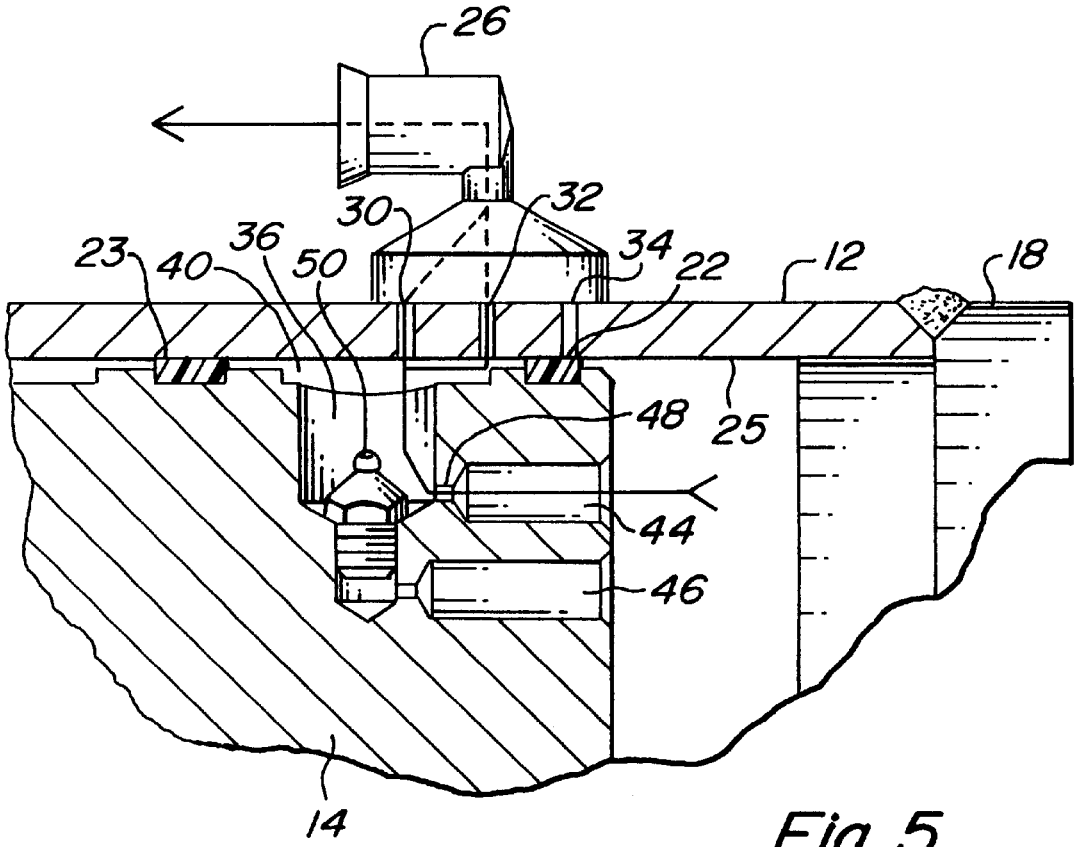

As illustrated in FIGS. 1–5 the hydraulic cylinder 10 is being retracted by the application of pressurized fluid through second hydraulic port 28 to the rod side of the hydraulic cylinder 10. Fluid is exhausted from the piston side of the hydraulic cylinder 10 through first hydraulic port 26 and returned to a sump. As is best illustrated in FIG. 2, the exhausted fluid from the piston side passes through all three metering orifices 30, 32 and 34 and out the first hydraulic port 26. In the next figure, FIG. 3, the hydraulic cylinder 10 has been further retracted and first circumferential seal 22 blocks the first metering orifice 30. By blocking the first metering orifice 30 the flow of fluid out of the piston side of the hydraulic cylinder 10 is restricted slowing the movement of the piston 14. As the hydraulic cylinder 10 is further retracted, as illustrated in FIG. 4, the seal 22 blocks the second metering orifice 32. However, the first longitudinal passage 44 and orifice 48 allows a limited amount of exhausted fluid to move into the first bore 36 and associated first cavity 40 and out through the now unblocked first metering orifice 30. The flow of exhausted fluid through this path is controlled by the passage orifice 48 as it is smaller than any of the metering orifices 30, 32 and 34. In FIG. 5, the hydraulic cylinder 10 has retracted further and the third metering orifice 34 is now blocked by the seal 22 fluid can only be exhausted from the piston side by passing through the first passage 44 and orifice 48 restricting the flow of exhausted fluid. In this way the flow of fluid being exhausted from the piston side is further restricted further slowing the movement of the piston 14.

The cushioning effect can be controlled by proper sizing of the three metering orifices 30, 32 and 34 and passage orifice 48. Before the cushioning structure takes effect, the flow of exhausted fluid is limited by the sizes of the metering orifices 30, 32 and 34 (FIG. 2). Next the flow of exhausted fluid is controlled by the size of the second and third metering orifices 32 and 34 (FIG. 3). As the piston 14 proceeds a little further, the flow of exhausted fluid is controlled by the third metering orifice 34 and passage orifice 48 (FIG. 4). At the end of its stroke the flow of exhausted fluid is controlled by passage orifice 48 alone (FIG. 5). The second circumferential seal 23 prevents the short circuiting of hydraulic fluid passing through the passage orifice 48.

In some applications it may be desirable to have one, two, or more than three metering orifices in the side wall of the hydraulic cylinder. In addition, the metering orifices maybe widely separated from one another to better control the acceleration and deacceleration characteristics of the piston.

Figure 6:
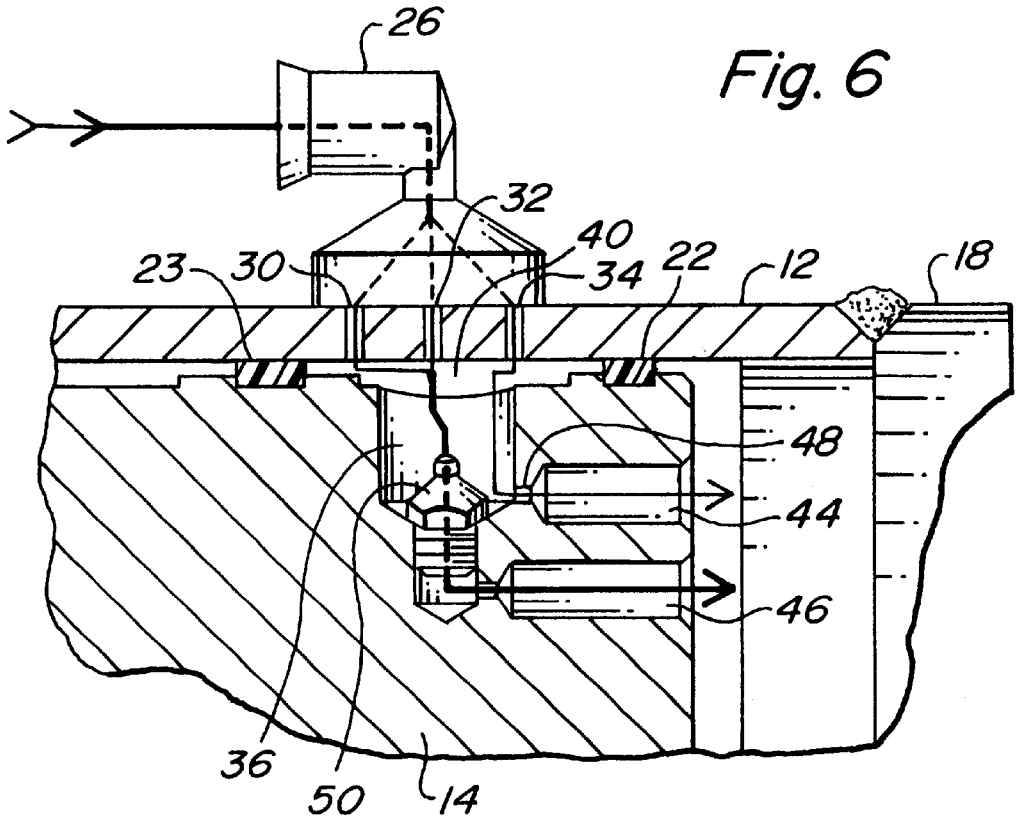

FIG. 6 illustrates the extension of the hydraulic cylinder 10 from a fully retracted position. Pressurized hydraulic fluid is directed to port 26 and passes through the three metering orifices 30, 32 and 34 the cavity 40 and into bore 36. From the bore 36 the pressurized fluid flows through both longitudinal passages 44 and 46 to the piston side of the piston 14.

ASSIGNMENT

The entire right, title and interest in and to this application and all subject matter disclosed and/or claimed therein, including any and all divisions, continuations, reissues, etc., thereof are, effective as of the date of execution of this application, assigned, transferred, sold and set over by the applicant(s) named herein to Deere & Company, a Delaware corporation having offices at Moline, Ill. 61265, U.S.A., together with all rights to file, and to claim priorities in connection with, corresponding patent applications in any and all foreign countries in the name of Deere & Company or otherwise.

The present invention should not be limited by the above described embodiments, but should be limited solely by the claims that follow:

1. A hydraulic cylinder comprising:

a cylindrical tube having an inside wall;

a piston having a rod attached thereto is slidably received in the cylindrical tube and defines a piston side and a rod side of the hydraulic cylinder, the piston is provided with first and second circumferential seals that engage the inside wall of the cylindrical tube and prevent the longitudinal flow of fluid between the piston and the inside wall of the tube, the piston is also provided with a bore having a first passage that is provided with a passage orifice which is in fluid communication with one of the piston side and the rod side of the hydraulic cylinder wherein the bore extends radially inward from the inside wall of the cylindrical tube and the first passage extends longitudinally from the bore, the piston is provided with a longitudinally extending cavity adjacent to the inside wall of the tube, the longitudinally extending cavity communicates with the bore which extends radially inward from the cavity, the bore is provided with a second passage that is parallel to the first passage and extends longitudinally between the bore and one of the piston side and the rod side of the hydraulic cylinder;

a piston side end cap for sealing the piston side of the hydraulic cylinder;

a rod side end cap through which the rod passes for sealing the rod side of the hydraulic cylinder;

a port for exhausting fluid from the tube, the port being in fluid communication with first and second metering orifices formed in the cylindrical tube longitudinally spaced from one another, wherein movement of the piston in the tube causes the first circumferential seal to cover the first metering orifice in the cylindrical tube preventing the passage of fluid through the first metering orifice while the second metering orifice remains open, further movement of the piston allows the first circumferential seal to reopen the first metering orifice and subsequently closes the second metering orifice preventing the flow of fluid through the second metering orifice, fluid can then pass through the passage orifice into the now open first metering orifice.

2. A hydraulic cylinder as defined by claim 1 wherein the second passage is provided with a check valve that prevents the flow of fluid.

3. A hydraulic cylinder as defined by claim 2 wherein the hydraulic cylinder is a double acting hydraulic cylinder having a second hydraulic port.

4. A hydraulic cylinder as defined by claim 3 wherein the tube wall is provided with a third metering orifice and the piston is provided with a third circumferential seal.

5. A hydraulic cylinder as defined by claim 4 wherein the first second and third circumferential seals are longitudinally spaced from one another with the first and second circumferential seals being longitudinally separated by the cavity.

6. A double acting hydraulic cylinder comprising:

a cylindrical tube having an inside wall;

a piston having a rod attached thereto is slidably received in the cylindrical tube and defines a piston side and a rod side of the hydraulic cylinder, the piston is provided with first, second and third circumferential seals that engage the inside wall of the cylindrical tube and prevent the longitudinal flow of fluid between the piston and the inside wall of the tube, the piston is also provided with a first bore having a first passage that is provided with a passage orifice which is in fluid communication with the piston side of the hydraulic cylinder, the piston is also provided with a second bore having a first passage that is provided with a passage orifice which is in fluid communication with the rod side of the hydraulic cylinder;

a piston side end cap for sealing the piston side of the hydraulic cylinder;

a rod side end cap through which the rod passes for sealing the rod side of the hydraulic cylinder;

a first port for exhausting fluid from the piston side of the hydraulic cylinder, the first port being in fluid communication with a first set of first, second and third metering orifices formed in the cylindrical tube longitudinally spaced from one another, wherein movement of the piston in the tube causes the first circumferential seal to cover the first metering orifice in the cylindrical tube preventing the passage of fluid through the first metering orifice while the second and third metering orifices remain open, further movement of the piston reopens the first metering orifice and the first circumferential seal subsequently closes the second metering orifice preventing the flow of fluid through the second metering orifice, fluid can then pass through the passage orifice into the now open first metering orifice, additional movement of the piston reopens the second metering orifice and the first circumferential seal then closes the third metering orifice fluid can then pass through the passage orifice into the reopened first and second metering orifices; and a second port for exhausting fluid from the rod side of the hydraulic cylinder, the second port being in fluid communication with a second set of first, second and third metering orifices formed in the cylindrical tube longitudinally spaced from one another, wherein movement of the piston in the tube causes the third circumferential seal to cover the first metering orifice in the cylindrical tube preventing the passage of fluid through the first metering orifice while the second and third metering orifices remain open, further movement of the piston reopens the first metering orifice and the third circumferential seal then closes the second metering orifice preventing the flow of fluid the second metering orifice fluid can then pass through the passage orifice into the now open first metering orifice, additional movement of the piston reopens the second metering orifice and the third circumferential seal subsequently closes the third metering orifice, fluid can then pass through the passage orifice into the reopened first and second metering orifices, wherein the first bore is provided with a first cavity extending longitudinally between the piston and the inside wall of the tube and the second bore is provided with a second cavity that extends longitudinally between the piston and the inside wall of the tube.

7. A double acting hydraulic cylinder as defined by claim 6 wherein the first cavity is located between the first and second circumferential seals and the second cavity is located between the second and third circumferential seals.

8. A double acting hydraulic cylinder as defined by claim 7 wherein the first bore extends radially inward from the first cavity and the second bore extends radially inward from the second cavity.

9. A double acting hydraulic cylinder as defined by claim 8 wherein the first passage of the first bore extend longitudinally from the bore to the piston side of the hydraulic cylinder and the first passage of the second bore extends longitudinally from the second bore to the rod side of the piston.

10. A double acting hydraulic cylinder as defined by claim 9 wherein each first and second bore is provided with a second passage that is parallel to the respective first passage of each bore, the second passage of the first bore extends between the first bore and the piston side of the hydraulic cylinder, the second passage of the second bore extends from the second bore to the rod side of the hydraulic cylinder.

11. A double acting hydraulic cylinder as defined by claim 10 wherein each of the second passages of the first and second bores are provided with a check valve which prevents the flow of fluid.

* * * * *